US005566702A

United States Patent [19]

Philipp

[11] Patent Number: 5,566,702

[45] Date of Patent: Oct. 22, 1996

[54] ADAPTIVE FAUCET CONTROLLER MEASURING PROXIMITY AND MOTION

[76] Inventor: Harald Philipp, 651 Holiday Dr., Bldg. 5, Suite 300, Pittsburgh, Pa. 15220

[21] Appl. No.: 366,814

[22] Filed: Dec. 30, 1994

[51] Int. Cl.[6] ..... E03C 1/05

[52] U.S. Cl. ..... 137/1; 137/624.11; 251/129.04

[58] Field of Search ..... 137/1, 624.11; 251/129.04; 4/623

[56] References Cited

U.S. PATENT DOCUMENTS

| | | | |
|---|---|---|---|
| 4,823,414 | 4/1989 | Piersimoni et al. | 137/624.11 X |
| 4,981,158 | 1/1991 | Brondolino et al. | 137/624.11 |
| 5,025,516 | 6/1991 | Wilson . | |
| 5,033,508 | 7/1991 | Laverty, Jr. . | |
| 5,063,622 | 11/1991 | Tsutsui et al. . | |
| 5,086,526 | 2/1992 | van Marcke . | |
| 5,217,035 | 6/1993 | van Marcke . | |
| 5,224,685 | 7/1993 | Chiang et al. . | |
| 5,281,808 | 1/1994 | Kunkel . | |

FOREIGN PATENT DOCUMENTS

| | | |
|---|---|---|
| 2652021 | 5/1978 | Germany . |
| 2264557 | 9/1993 | United Kingdom . |

*Primary Examiner*—Kevin Lee
*Attorney, Agent, or Firm*—David Kiewit

[57] ABSTRACT

An electronically controlled automatic faucet has a pulsed infrared beam intersecting the water stream discharged by the faucet. Infrared signals reflected from the water stream are thus detected in addition to any signals reflected from a user's hand(s). A reasonable approximation of the signal received from the water stream alone is subtracted from the sum of all detected signals whenever water is flowing in order to provide a compensated proximity signal. This compensation method, which may be implemented in hardware or software, prevents a shift in the sensor's sensitivity during periods when water is flowing, and eliminates the possibility that water flow might "lock-on" once initiated. Compensating for water flow improves sensor performance by allowing the infrared detection field to encompass a larger volume of space where a user's hands might be found. In addition, the same, or similar, hardware can be used to detect a user's hand motion. The disclosed motion detection method can be used alone, or it can be used as an adjunct to the water stream compensation method, in which case it prevents extended intervals of water flow that could otherwise occur when foreign objects are left in view of the sensor.

29 Claims, 8 Drawing Sheets

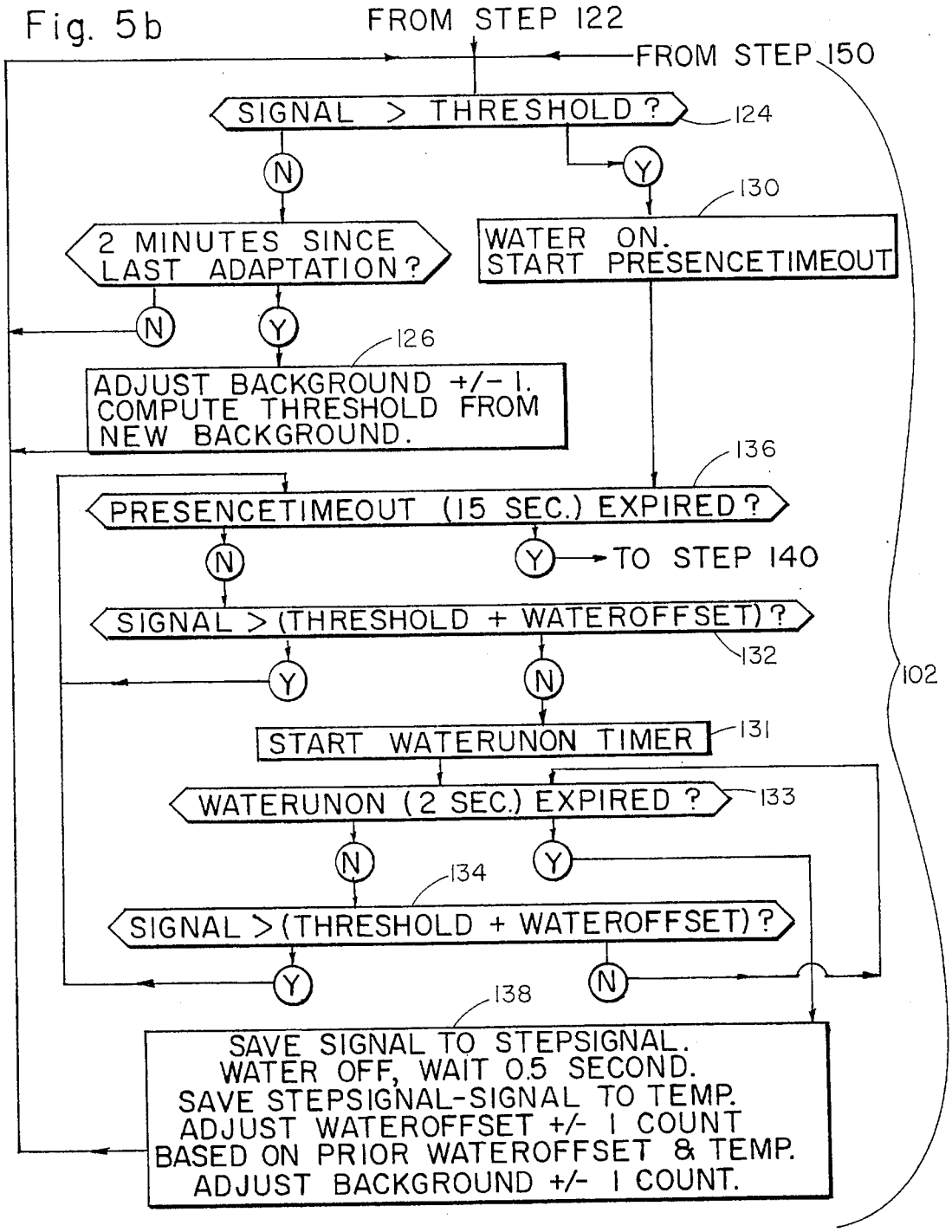
Fig. 5b
FROM STEP 122
FROM STEP 150
SIGNAL > THRESHOLD ?
124
N
Y
130
2 MINUTES SINCE LAST ADAPTATION ?
WATER ON. START PRESENCETIMEOUT
N
Y
126
ADJUST BACKGROUND +/- 1. COMPUTE THRESHOLD FROM NEW BACKGROUND.
136
PRESENCETIMEOUT (15 SEC.) EXPIRED ?
N
Y
TO STEP 140
SIGNAL > (THRESHOLD + WATEROFFSET) ?
132
Y
N
102
START WATERUNON TIMER
131
WATERUNON (2 SEC.) EXPIRED ?
133
N
Y
134
SIGNAL > (THRESHOLD + WATEROFFSET) ?
Y
N
138
SAVE SIGNAL TO STEPSIGNAL. WATER OFF, WAIT 0.5 SECOND. SAVE STEPSIGNAL-SIGNAL TO TEMP. ADJUST WATEROFFSET +/- 1 COUNT BASED ON PRIOR WATEROFFSET & TEMP. ADJUST BACKGROUND +/- 1 COUNT.

ADAPTIVE FAUCET CONTROLLER MEASURING PROXIMITY AND MOTION

TECHNICAL FIELD

This invention relates to sensing devices for the electronic activation and control of water flow through a faucet, in order to provide touch-free operation thereof.

BACKGROUND OF THE INVENTION

Various methods have been employed to electronically control water flow through a faucet or spout. Predominant among the accepted methods is the use of an optical sensor, preferably comprised of a pulsed infrared ("IR") emitter and an IR detector which, together with processing electronics, are used to control one or more solenoid valves. In this method, the reflections of a pulsed IR beam from objects (e.g., a user's hands) are sensed and used to determine whether to activate or deactivate a solenoid valve. Pulsed IR sensing has been dominant due to its reasonable performance and low cost. Pulsed IR processing circuitry typically consists of some mixed analog and digital components and perhaps even a microprocessor.

Prior art pulsed IR sensors of the type made integral to a faucet have substantial problems arising from a need to suppress reflections from the water stream itself. As is well known in the art, the water stream reflects near-IR light. The resulting reflections of IR signals from the water stream when an IR emitter is mounted behind an aerator has caused engineers to design optical paths that avoid such reflections. If the reflection is not avoided, the water stream can create enough of a reflection to force the solenoid valves to "lock-on", causing a waste of water and a great annoyance to the user. Under such conditions, only when the electronics "times out" and deactivates the electric valve will water flow ultimately cease. The total elapsed time period of a lock-on can be as long as several minutes, depending on the preset time-out delay chosen by the manufacturer.

One approach to avoiding water stream reflections is disclosed in U.S. Pat. No. 5,025,516, wherein the optical paths of the IR emitter and IR detector are made convergent to a zone just behind the water stream and just short of the basin. Other known approaches involve: 1) emitting a narrow beam of IR to one side of the water stream; 2) emitting the IR at a sufficiently oblique angle to the water stream that no reflections from it are detected; or, 3) decreasing the sensor's overall sensitivity. Sensors using the latter approach have difficulty adequately sensing hands with dark skin color, and also provide poor detection continuity.

The chief problems with convergent optics are: 1) A narrow detection field, with a resulting poor tolerance to variations in the hand positions needed either to initiate water flow or to maintain water flow continuity; 2) an increase in product cost as a result of the need for lenses or other focusing means, and; (3) a need for greater complexity in the mechanical configuration of the water spout itself to accommodate the optics needed to generate the convergent optical beams.

Another common problem with existing sensor designs is the inability to recover from common and unavoidable environmental problems, such as water and/or soap films running down the optical lenses, paper towels thrown over the spout, debris left in the basin, etc. Such occurrences cause reflective IR signal changes that existing sensor designs are poorly equipped to tolerate. For example, a soap bubble clinging to an optical lens can bias the optical background reflection higher and thereby make the sensor more sensitive to a subsequent detection. If a great enough optical feedback path is created, the sensor can begin to run continuously until the sensor times out and shuts down. Likewise, a paper towel draped over the spout can cause the water to run on for a long time, also creating a time-out condition resulting in complete inoperability. In fact, the only reasonable recourse for existing sensor designs has been to shut down and become completely inoperable in the face of a soap bubble or foreign object that causes enough signal reflectance to create a permanent trigger. U.S. Pat. No. 4,682,628 describes such a method. Only when the obstruction is removed will such a sensor recover and begin to operate once again.

Another shortcoming of existing sensor designs is an inability to adapt to changes in background signal level associated with a gradual discoloration of the sink, a gradual degradation of the lens due to the use of abrasive cleaning compounds, a gradual degradation of the IR emitter performance, and the like. Existing sensors employ a fixed sensitivity threshold which is set either at the factory or by the installer (or both). Subsequently, as sensitivity is affected by environmental factors, the sensor's performance will degrade, and may fall off far enough to warrant a service call. More likely the gradual degradation will not be noticed, and the poor performance will be taken by the users as "normal".

It is generally recognized that automatic faucets are often installed by individuals who have limited electronics skills and who are not cognizant of proper methods for setup and adjustment. Existing sensor designs usually require the installer to make some adjustment in sensor sensitivity. Even if such an adjustment is not required (e.g., when preset at the factory) the mere presence of an adjustment invites the installer to "play" with the sensitivity control, often in a deleterious manner.

SUMMARY OF THE INVENTION

A preferred embodiment of the invention provides adaptive computer-controlled apparatus determining the presence or absence of a user's hands proximate a faucet and controlling water flow out of the faucet in response to that determination. The reliability of determination of whether a user's hands are present is enhanced by the selective use of either infrared proximity sensing or infrared motion sensing. Reliability is further enhanced by removing measurement artifacts caused by flowing water.

In a preferred embodiment, a microprocessor or microcomputer having a signal processing algorithm stored in computer memory is employed to intelligently make decisions regarding the state of the output of an automatic faucet control. These decisions are predicated on the current signal strength of reflected pulsed IR; the history of prior detected IR signals; and on certain preprogrammed detection criteria.

It is an object of the invention to provide an automatic faucet control apparatus having infrared proximity sensing means with a sense field broad enough to allow detection for a wide range of hand positions.

It is an additional object of the invention to provide an automatic faucet control comprising electronic signal processing circuitry and having infrared proximity sensing means insusceptible to the presence of a water stream within its field of view.

It is yet a further object of the invention to provide a microprocessor-controlled automatic faucet having logic means adapting the apparatus to operate with foreign objects, soap bubbles, and the like within its infrared sensing field.

It is additionally an object of the invention to provide an automatic faucet control apparatus installable without field calibration or sensitivity adjustment.

It is yet a further object of the invention to provide an automatic faucet control comprising sensing means automatically adapting to slow environmental changes such as dirt buildup, circuit drift and the like, and thereby to provide a constant performance over time.

BRIEF DESCRIPTION OF THE DRAWING

FIG. 5*b* of the drawing is the second portion of the flow chart begun in FIG. 5*a*, showing a set of proximity sensing steps.

DETAILED DESCRIPTION

Figure 1A:
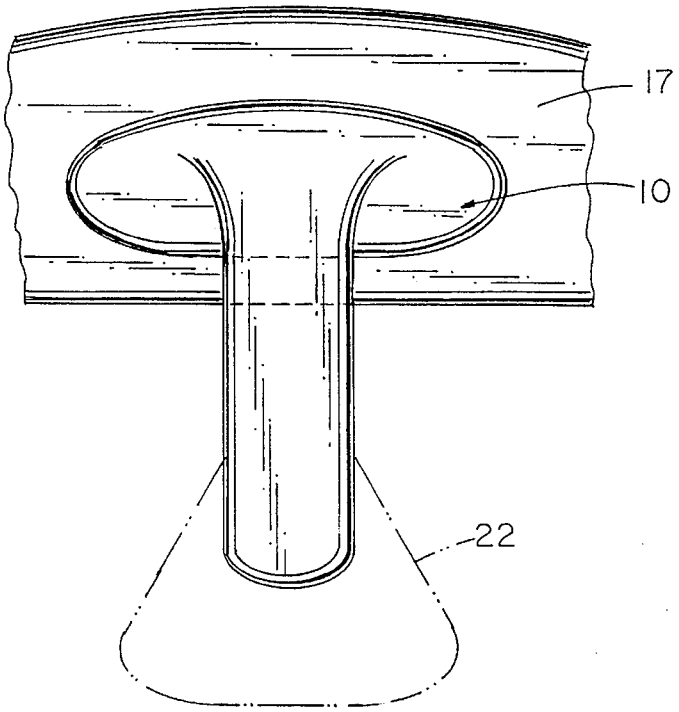
FIG. 1*a* of the drawing is a plan view of a faucet and shows the effective infrared detection field of a sensor mounted in the faucet and aimed forward towards a user.
Figure 1B:
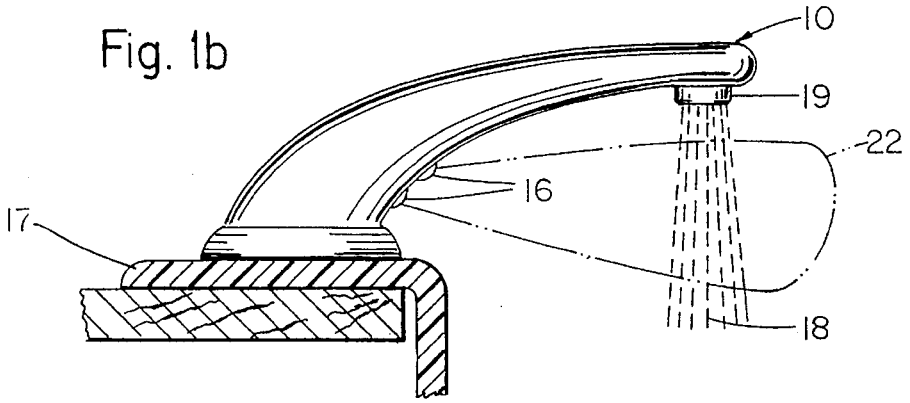
FIG. 1*b* of the drawing is a side elevation view of the faucet of FIG. 1*a* showing the infrared detection field intersecting the water stream.
Figure 1C:
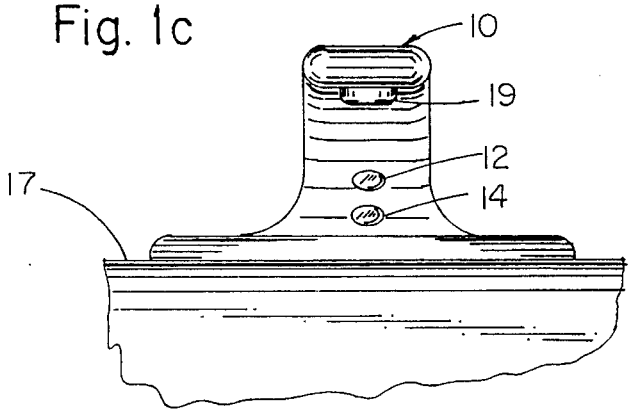
FIG. 1*c* of the drawing is a front elevation view of a faucet showing the IR emitter and detector.

Turning initially to FIGS. 1*a*, 1*b* and 1*c* of the drawing, one finds a faucet 10, comprising an IR emitter 12 and IR detector 14, both suitably protected behind IR-transmissive lenses 16 near the base of the faucet 10 adjacent a top surface of a washbasin 17. In certain cases these lenses 16 may be combined into a single element for economy of manufacture, with the emitter 12 and detector 14 situated behind a single lens 16 having an opaque partition (not shown) between them to minimize direct coupling of IR signals from emitter 12 to detector 14. When the faucet 10 is turned on, a water stream 18 emanates from the aerator or other discharge outlet 19 of the faucet 10, directly in front of and in full view of both the IR emitter 12 and detector 14. This geometry will cause IR radiation emitted by the emitter 12 to be reflected from the water stream 18 so that the detector 14 has reflected infra-red radiation incident thereupon. In prior art automatic faucet controllers this reflected radiation, which is of sufficient intensity to produce a substantial corresponding output signal from the detector 14, causes serious problems relating to sensitivity limits and to water lock-on.

As is well known in the faucet control art, there is a limited sensing field 22, or effective field of view 22 within which a user's hands will reflect a pulse from the emitter 12 (the pulse being emitted into an emitter field of view 21) and that can be received with a useful intensity by the detector 14 (which has a detector's field of view 23). In a preferred embodiment of the invention this sensing field 22, shown in phantom in FIGS. 1*a*–1*c*, 2 and 4 of the drawing, has a very wide angle in order to allow detection over a broad zone. In practice, the field of view 22 can be easily shaped as an oval having a predominantly horizontal presentation to provide an optimal detection zone 22. In any case, the volume of space to be sensed must be illuminated by the IR emitter 12, and this same volume must also be within view of the IR detector 14 so that the detector 14 can provide useful output signals corresponding to the intensity of a reflected portion of radiation emitted by the emitter 12.

It is also known in the art that measuring the reflectance of a stream of water with an emitter-detector pair can be done with a wide variety of technical approaches. A number of different emitters radiating electromagnetic radiation can be considered, as long as these emitters emit electromagnetic radiation in a region of the spectrum in which water is reflective. Such electromagnetic radiation emitters include light emitting diodes emitting visible or ultraviolet radiation, and microwave sources. Acoustic emitters and detectors, in particular those operating in the ultrasonic frequency range could also be considered for use in the method and apparatus of the invention.

Figure 2:
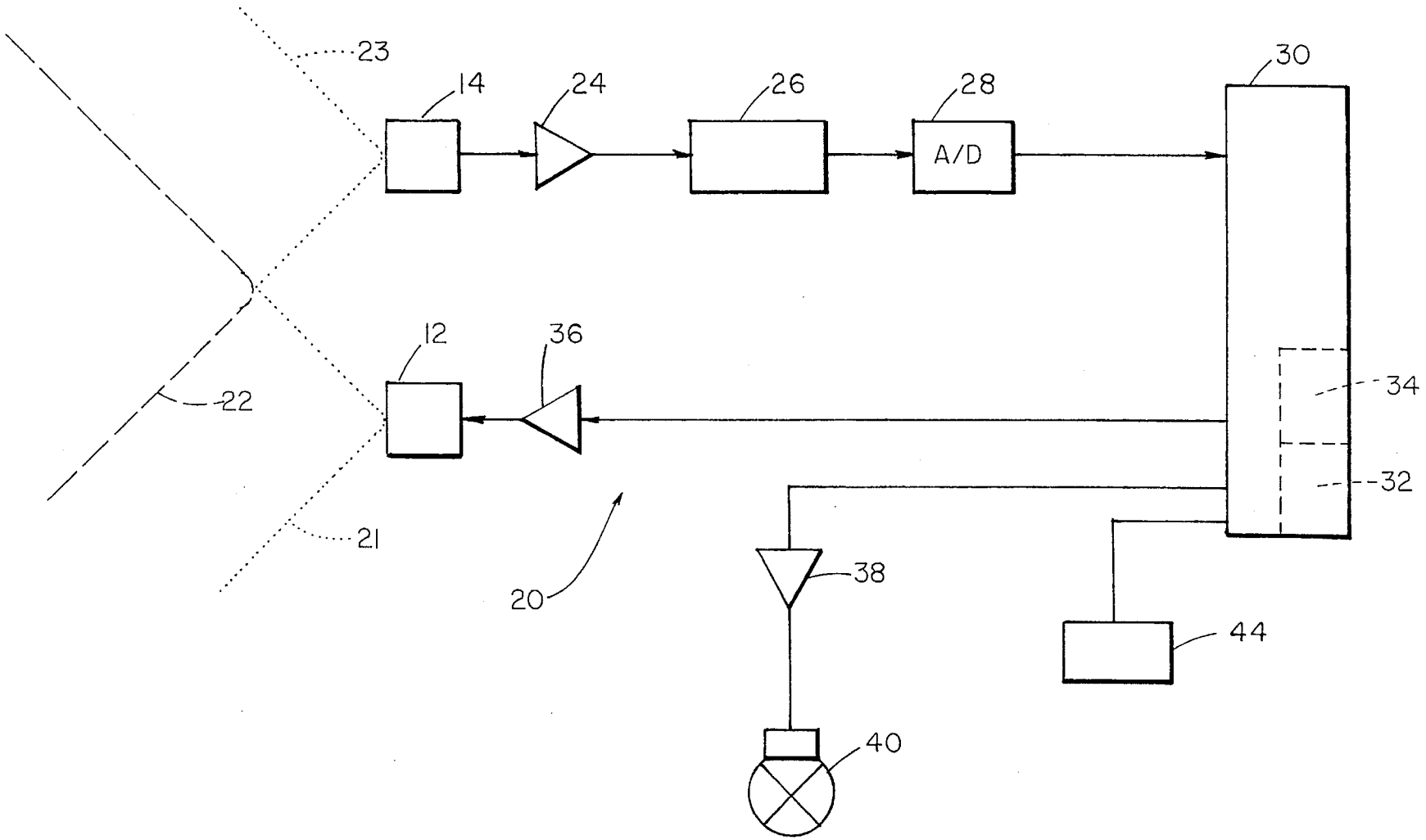
FIG. 2 of the drawing is a schematic block diagram of circuitry employed within an automatic faucet control of the invention.
Figure 3:
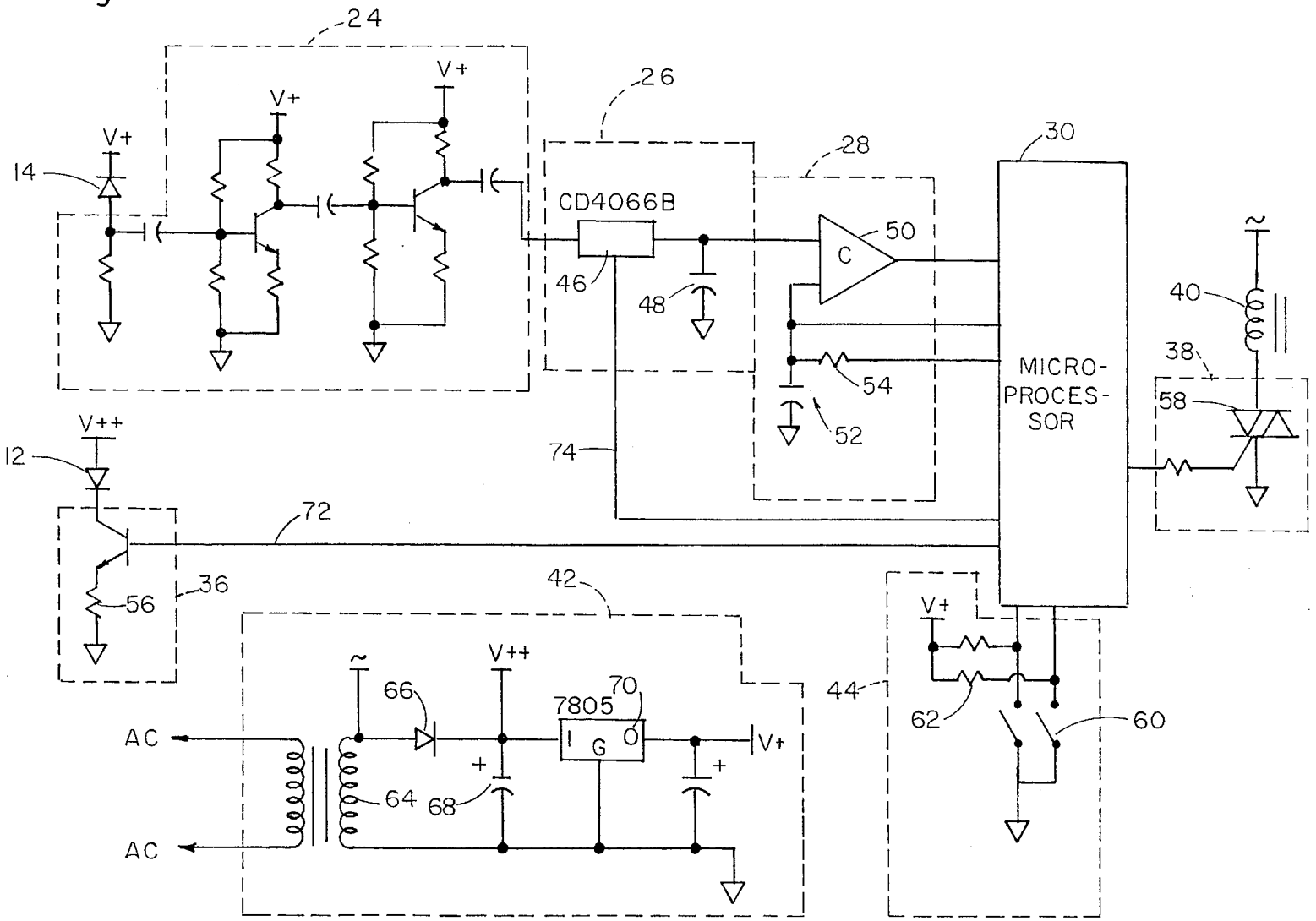
FIG. 3 of the drawing is a circuit diagram showing additional details of elements shown in FIG. 2.

FIG. 2 shows a circuit block diagram for a preferred controller 20, and FIG. 3 shows additional detail thereof. The indicated blocks comprise an IR emitter 12 and detector 14; an amplifier for the detected signals 24; a signal detector 26; an analog to digital converter (ADC) 28; a microprocessor or microcomputer 30, having RAM 32 and ROM 34 memory associated therewith; an IR emitter driver 36; a driver 38 for an electrically actuated water valve 40 (which is preferably a solenoid-actuated valve); a power supply circuit 42; and an options selections circuit 44.

The microcomputer 30 may preferably be a Model 68HC05 made by the Motorola Corporation, which contains RAM 32 and ROM 32 circuitry. As is well known in the art, a wide variety of other selections could be made for this element, some of which contain integrated RAM 32 and ROM 34, and some of which function equivalently with external memory elements. It is also well known in the art to provide other circuit functions, such as analog-to-digital conversion 28 integrally packaged with a microcomputer 30.

As indicated in FIG. 3 of the drawing, amplifier 24 preferably comprises a two-stage moderate gain pulse amplifier that is AC coupled to suppress DC and low frequency components from its output. Detector 26 comprises a sampling switch 46 and a hold capacitor 48. ADC circuit 28 comprises a voltage comparator 50 having a binary output indicative of the relative polarity of its two analog input signals, and a simple resistive/capacitive ramp circuit 52 capable of being charged and rapidly discharged, The voltage on the capacitive ramp circuit 52 depends on the time duration of a voltage output by the microcomputer 30 through a resistor 54. IR emitter driver 36 preferably comprises a simple NPN transistor driver circuit whose output current depends on the value of an emitter resistor 56 and on the voltage of the pulse supplied by the microcomputer 30. Solenoid drive circuit 38 comprise a triac circuit 58 capable of driving current through valve solenoid 40. Options circuit 44 comprises at least one switch 60 and a pull-up resistor 62, which feeds into port pins of the microcontroller 30. The power supply circuit 42 preferably includes a line transformer 64, a rectifier 66, a filter capacitor 68, and an integrated circuit voltage regulator 70 having sufficient stability to power all circuit elements without causing excess interference or instability.

Of note in FIG. 3 are control lines 72, 74 carrying voltage pulses of height V+ to the IR emitter driver 36 and to the sampler circuit 26, respectively. When 72 goes high, current begins to flow through the IR emitter 12 soon afterward. IR light is thus emitted, reflected, and detected by photodetector 14. After a reasonable interval of fixed duration, typically ten to twenty microseconds, the signal on 72 Is terminated, thus defining the end of the emitted IR pulse. Those practiced in the art will recognize that for a few microseconds after the initiation of a pulse on 72, the output of the amplifier 24 will contain a glitch due to circuit cross talk. Also, the output of the amplifier 24 will not completely represent the full reflected signal level for a few microseconds, because of the response times of the driver 36, the emitter 12, the detector 14, and of the amplifier 24 itself. Since the signal will not be stable for some microseconds after the pulse on 72 begins, it is preferred to delay the start of the sample pulse on 74 by a few microseconds, and to terminate it simultaneously with the termination of the pulse on 72. Software within microcomputer 30 is fully capable of creating these timing delays. The actual timing skew required is dependent on circuit board layout and on device characteristics of the emitter, detector, and amplifier circuitry.

It will be recognized by practitioners of the art that the sampling circuit described supra comprises a synchronous detector, well known to possess a very high detection 'Q' relative to other more primitive methods such as rectifying circuits. However, it can be appreciated that other detection techniques can also be gainfully employed to accomplish a similar result. Similarly, many other methods and circuits can be employed to achieve signal gain for circuit 24, to construct an ADC 28, to make drivers 36 and 38, and to provide a circuit power supply 42. In fact, some or all of these elements may be obtainable commercially as off-the-shelf integrated circuits.

A practitioner of the art can readily ascertain the critical design parameters for each circuit block, and can thus determine actual component values, by knowledge of the following general design criteria:

- The IR pulse should be wide enough to allow sufficient time for signal settling, as determined from the rise time and settling specifications of the emitter 12, detector 14, and amplifier 24.
- The gain of the amplifier 24 should be selected to provide a reasonable detection sensitivity over the entire dynamic range of signals to be acquired, but should do so without serious distortion.
- Detector 26 should be capable of sampling approximately the last 50% of the IR pulse width. If the microprocessor 30 is to directly form the pulse, a microcomputer 30 with a fast enough instruction rate is required.
- The pulse driver 36 should be capable of driving an IR emitter 12 with a reasonable pulse of current that is neither high enough to cause damage, nor low enough to create an emitted signal too weak to be detected.
- Solenoid driver 38 should be able to conservatively handle the current required for solenoid valve 40.
- Power supply 42 should be designed conservatively enough to deliver enough peak and continuous current to the circuitry, with sufficient stability to ensure reliable operation.

As each of the circuit elements of FIG. 3 are quite conventional in scope, have no particular novelty in and of themselves, and are well understood by practitioners of the art, they will not be discussed further in depth.

Figure 4:
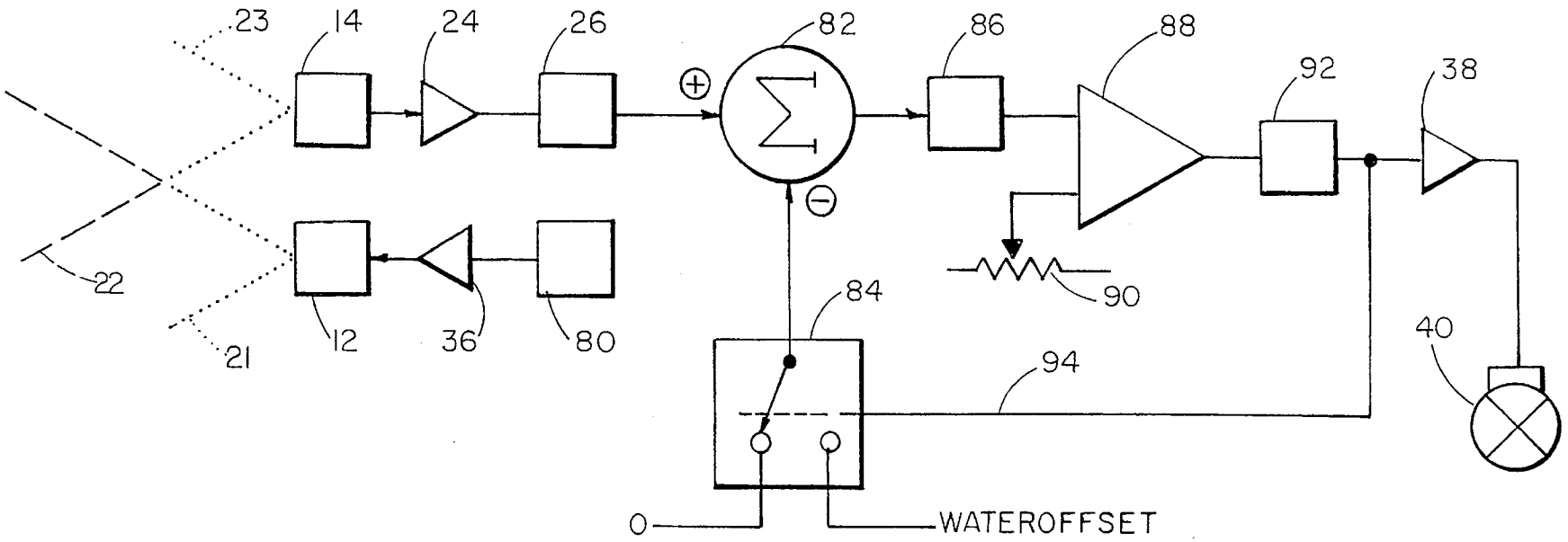
FIG. 4 of the drawing is a schematic circuit diagram of an alternate embodiment of the invention.

Although the preferred embodiment of the invention discussed supra employs computer-based signal processing circuitry, it will be realized that other signal processing approaches are possible. Turning now to FIG. 4 of the drawing, one finds an analog circuit usable in an alternate embodiment of the invention. In the circuit of FIG. 4, a pulse generator 80 operating at a preset rate supplies pulses to an emitter driver 36, which drives an IR emitter 12 functioning in an optical environment identical to that discussed hereinbefore. Reflected near-infrared radiation is detected by the IR detector 14, amplified in an input amplifier 24, detected with a signal detector 26 and passed to a summing circuit 82, which has as a second input the output of a signal switch 84. A portion of the output of the summing circuit 82 passes through a lowpass filter 86 and is input to a comparator 88, which has as its second input a signal that may be stored or preset at the time of installation (e.g., by the known combination of a known source voltage and a sensitivity adjustment potentiometer 90). If the input from the summing circuit 82 is high enough, the output from the comparator 88 triggers a re-triggerable one-shot circuit 92 used to control the valve driver 38 and thereby opens the valve 40. The output from the one-shot 92 is also used as a control input 94 to the signal switch 84. If the one-shot 92 is active, indicative of the valve 40 being open, the signal switch 84 applies a first input voltage (labelled "WATEROFFSET" in FIG. 4) to the summing circuit 82. In this analog embodiment of the invention, the stored value of the WATEROFFSET parameter is a constant predetermined value that may be preset during manufacture (e.g., by appropriate selection of a source voltage and of a dropping resistor) or may be set at the time of installation. Similarly to the digital embodiment described elsewhere herein, using the summing circuit 82 to subtract the WATEROFFSET value from the filtered input signal prevents the occurrence of a lock-on condition. If the one-shot 92 is not active, the signal switch 94 connects a predetermined voltage having a value (labelled "0" in FIG. 4) corresponding to a zero received signal to the summing circuit 82 so that no offset signal is provided.

SOFTWARE DESCRIPTION

Figure 5A:
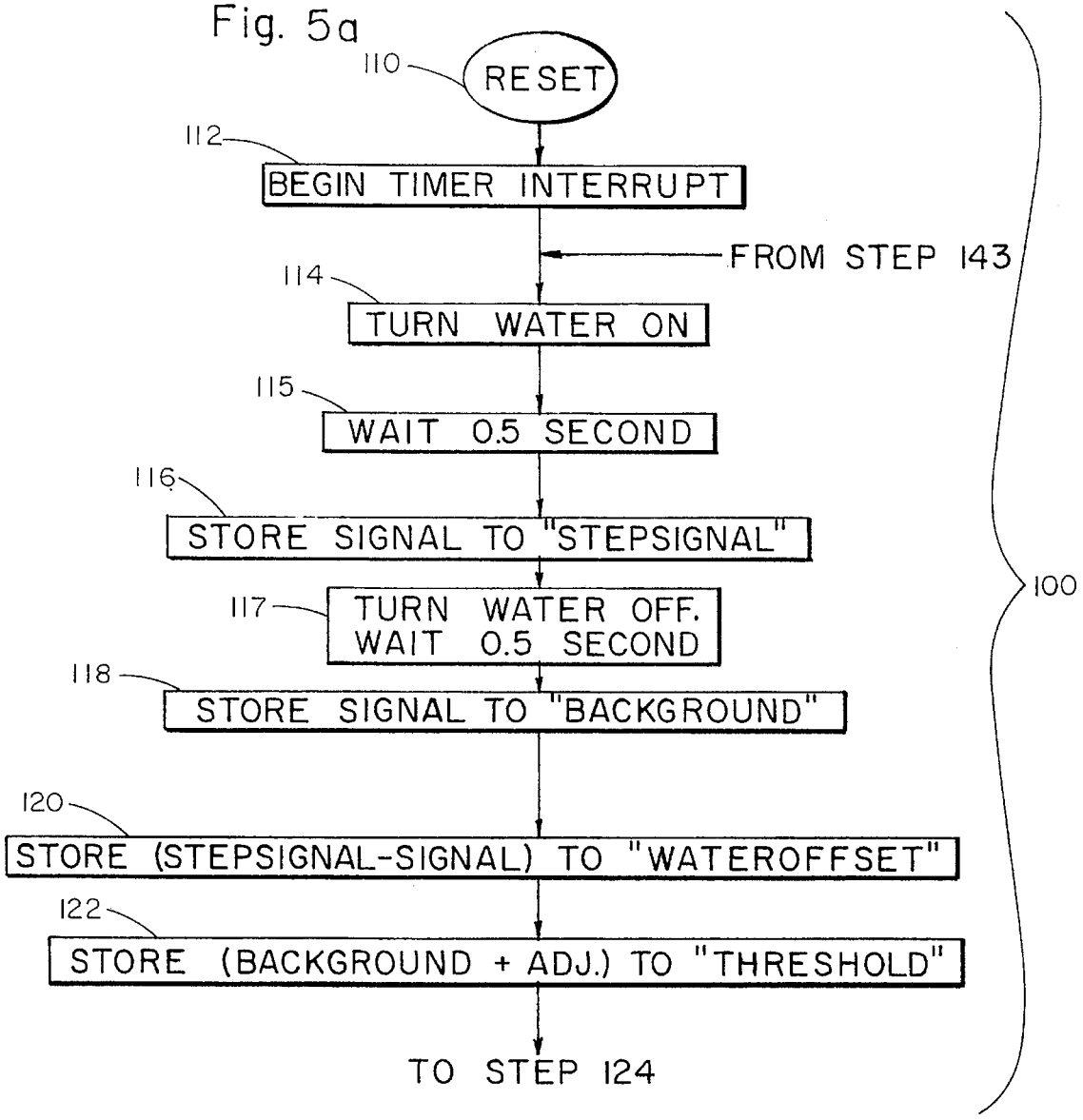
FIG. 5*a* of the drawing is a first portion of a flow chart showing a set of logical set-up and calibration steps taken by the microcomputer of FIGS. 2 and 3.
Figure 5C:
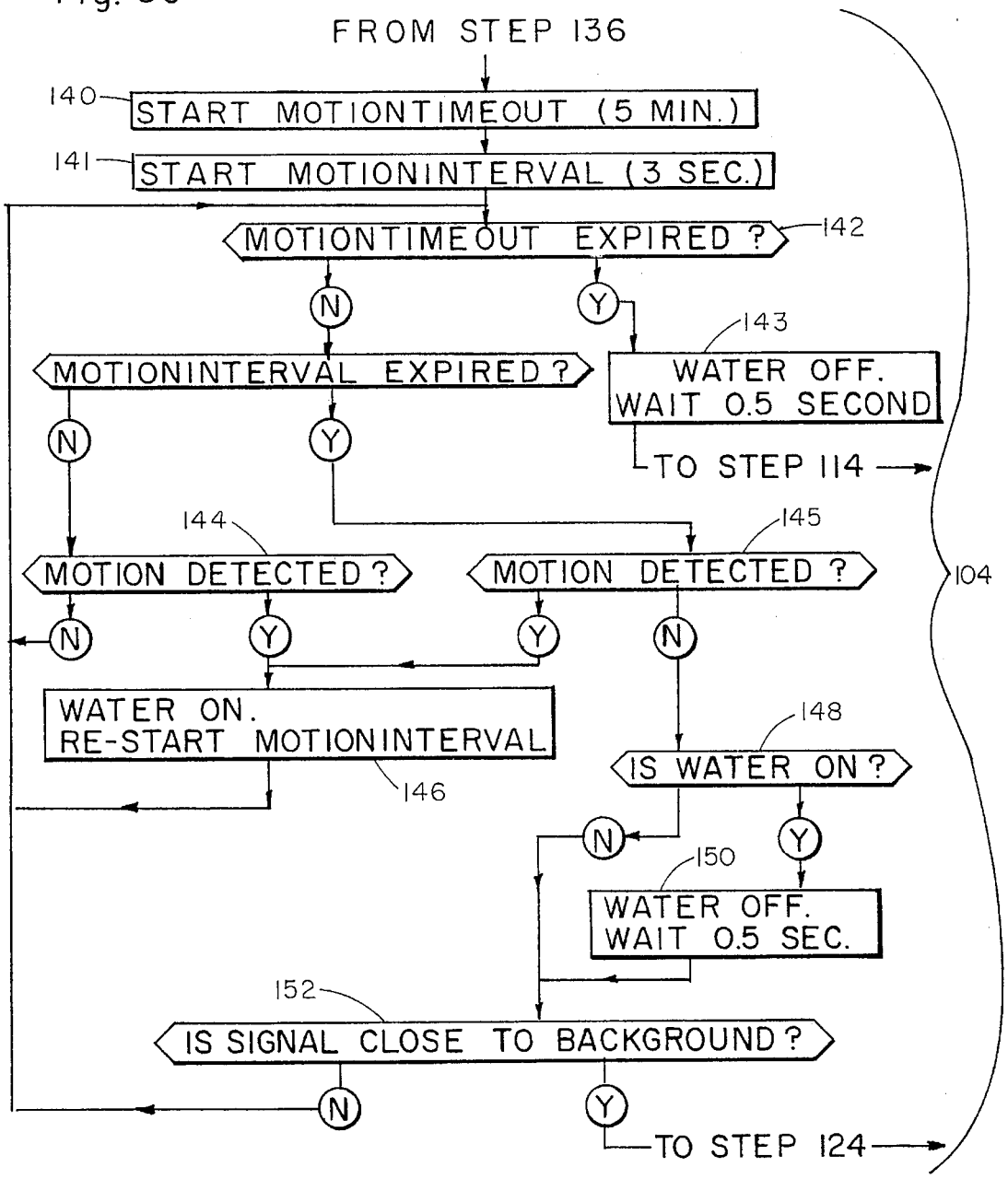
FIG. 5*c* of the drawing is the third portion of the flow chart begun in FIG. 5*a*, and shows a set of motion sensing steps.

The software contained in read-only memory associated with microcomputer 30 (often referred to as "firmware") acts to control the faucet according to an algorithm whose general logical flow is shown in FIGS. 5*a–c* of the drawing.

The flow chart of FIGS. 5*a–c* consists of three basic sections 100, 102, 104. The flow parts in section 100 refer to flow elements dealing with self-calibration and setup functions, such as initiating signal acquisitions, determining background signal levels, and the like. Section 102 deals with presence or proximity detection of an object such as a hand, in order to initiate and keep water flow on for an interval during which the object is proximate the sensor. Section 104 deals with motion detection and controls the faucet 10 to be on as long as a moving object is within the sensing field 22.

It will be clear to those skilled in the art of real-time control systems that in addition to the illustrated logical steps shown in the drawing, the microcomputer 30 also executes an interrupt routine to acquire signals and filter them in order to provide the algorithm with a value indicative of the reflected signal level. A preferred interrupt routine contains steps used to acquire and digitally filter the signal to remove noise and improve fidelity, and to provide a "SIGNAL value used in the presence and motion detection algorithms, as will be discussed in greater detail hereinafter. The interrupt routine is executed often enough to provide a reasonable response time for human approach, and with enough oversampling to allow for filtering of signal levels in order to suppress transient signals from ambient light or nearby electrical appliances. The interrupt interval may be either periodic or randomized, with random intervals being preferred if interference from external periodic sources (e.g., a flickering fluorescent tube) is a concern, because randomizing the intervals will suppress interference correlation effects.

In order to ignore the water stream reflection, the software acts to determine the amplitude of the IR signal reflected from the water stream 18 relative to the quiescent background IR reflectance level measured with neither a user's hands nor flowing water present. It can do so initially by forcing the water stream 18 to turn on when the unit is first powered up, recording the reflected IR signal level from the water stream plus background, and then shutting the water off and measuring the pure background IR signal level. The calibration routine then subtracts the signal level containing only the background level from the signal containing both background and water reflection components, and saves the result to a parameter labeled WATEROFFSET (Step 120). As an alternative, the sensing system can wait until the first use of the faucet and determine an initial value of WATEROFFSET from the measured quiescent background signal level with no water running, and from a signal level sensed after removal of the user's hands has led to a significant drop in signal level, i.e., just before the water is shut off. To facilitate the determination of when water can be shut off after the first activation following power-up, the sensor can be made to detect purely in a motion mode, or alternatively can be programmed for an initial approximation of WATEROFFSET so as to avoid a water lock-on condition.

To provide a slow, continual calibration and to compensate for background changes over time, the unit periodically compares the current background signal level to a stored background reference level BACKGROUND, and adjusts BACKGROUND by a very small amount (usually ±1 bit) each time. The interval is usually on the order of a minute, and may preferably be two minutes. The slow self adjustment only takes place when there is no ongoing detection of an object.

To prevent the unit from running continually due to the presence of an object (e.g., a paper towel) in the optical path, or another anomalous optical condition such as a soap bubble on a lens, the controller 20 switches into a motion detection mode after the expiration of a predetermined fixed interval during which presence is continually detected. For example, after fifteen seconds of continuous detection, the controller stops responding to the presence of an object, and begins to respond only to the motion of an object. If the object or condition does not move, then the reflected signal will be static, and the unit will terminate water flow. Should motion continue, the water solenoid 40 will stay on. Thus a moving hand will continue to provide functionality even after a fifteen second "time out". A paper towel in the sensor's field of view is generally a static object and will not move sufficiently to create a motion detection criteria, and so the water will stop flowing. A salient aspect of this solution is that if a paper towel is placed in the sense field, the motion of a human hand can make water flow even after the timeout interval of fifteen seconds or so has expired.

Another solution to the problem of ignoring water stream reflections is to use a motion detection mode as the sole mode of object detection. In some applications it is acceptable to provide "motion only" sensing of hand motion, for example in airport washrooms, where performance with largely stationary objects, such as coffee cups being held still whale being rinsed, is not important. It has been found experimentally that normal hand motion while washing generates enough signal variation to be easily discriminated from small fluctuations caused by water stream undulation. A pure motion mode as the default mode of operation is simple to program, and has the simultaneous benefit of ignoring water droplets on lenses, draped paper towels, and the like.

Referring now to section 100, software begins after power up reset in Step 110 by initiating (in Step 112) the interrupt routine employed to acquire the infrared signals as discussed supra. In Step 114 the microprocessor 30 initiates the flow of water and waits a short interval, preferably one half second, before saving the current value of SIGNAL to STEPSIGNAL in Step 116. The water is then shut off again and, after another delay (of preferably one half second) the present value of SIGNAL is stored to BACKGROUND in Step 118. The difference between the current values of STEPSIGNAL and SIGNAL is stored in Step 120 as a parameter named WATEROFFSET for future use. A comparison level is then defined by adding a predetermined value (labelled "ADJ" in Step 122) derived from the setting of optional input switches 44 to the value of BACKGROUND to create a new value, THRESHOLD, used in later steps of determining when to initiate water flow. In the absence of optional switches 44, a suitable fixed value of ADJ may be stored in a ROM 34 to set the value of THRESHOLD some incremental amount above BACKGROUND, as is commonly done in the control arts.

Section 102 contains the meat of the detection algorithm used to initiate water flow and provide continual background compensation. A repeated comparison of SIGNAL to THRESHOLD (Step 124) is done within a logical loop that is broken if the current value of SIGNAL exceeds THRESHOLD on at least one occasion within a predetermined time interval (preferably two minutes). If the SIGNAL never exceeds the THRESHOLD within the predetermined interval the current value of SIGNAL is compared to BACKGROUND and BACKGROUND is adjusted upwards or downwards by one count or by another very small amount, and the previous value of THRESHOLD is replaced by a new one corresponding to the new value of BACKGROUND, as indicated in Step 126.

If a user's hands are in the detection zone, then SIGNAL increases and the comparison in step 124 leads to detection, following which the solenoid valve 40 is opened to initiate water flow and a countdown timer, used to limit the length of time that water is allowed to flow without there being subsequent verification of continued need, is started in Step 130. This timer is preset to a stored value known as PRESENCETIMEOUT, which may conveniently be fifteen seconds. The PRESENCETIMEOUT timer, as well as other timers subsequently herein discussed may be counted down by simple software loop repetitions, or by means of additional steps in an interrupt routine to regularly decrement a physical counter.

After setting PRESENCETIMEOUT, the value of SIGNAL is compared to the value of THRESHOLD+WATEROFFSET in Step 132. By using a value higher than THRESHOLD by the WATEROFFSET amount, the effects of water stream reflection are effectively subtracted from the determination of an ongoing detection. WATEROFFSET could just as easily be subtracted from SIGNAL instead of being added to THRESHOLD; the numerical comparison effect is the same. This adjustment to THRESHOLD prevents a water flow lock-on effect, and allows for the use of relatively high levels of general sensitivity over a large detection volume of space encompassing the water stream. If SIGNAL exceeds THRESHOLD+WATEROFFSET, proximity detection is presumed to continue to be true, and the test is repeated.

If SIGNAL does not exceed THRESHOLD+WATEROFFSET in Step 132, a second timer, which is preset to a stored value known as WATERUNON is started, as shown in Step 131. The WATERUNON timer, which may conveniently be set for two seconds, serves to keep water flowing for a short period even after all detection has ceased. This is important to maintaining continuity of water flow over short intervals of time when a user's hands may be temporarily out of the water stream.

During the period that WATERUNON is counting down the water is left on and the threshold test is repeated, as indicated in Step 134. If WATERUNON times out in Step 133 while PRESENCETIMEOUT is still running, a set of adaptive measures are taken as shown in Step 138. These adaptations comprise saving the current value of SIGNAL to STEPSIGNAL, shutting off the water, waiting for a shutdown settling interval (preferably one half second) to expire, and subtracting the value of SIGNAL from the value of STEPSIGNAL to determine a new value of the water-offset variable, called TEMP. TEMP does not replace the value of WATEROFFSET saved in Step 120; rather, in Step 138 the new water-offset and WATEROFFSET values are compared, and if they differ, no matter by how much, the value of WATEROFFSET is adjusted by a very small amount in the direction of the measured water-offset, such as by ±1 count, so as to make gradual changes in its value. Step 138 also alters BACKGROUND in a similar ±1 count fashion, based on the prior value of BACKGROUND and the current level of SIGNAL. After Step 138, logical flow returns the program to the primary detection step, 124.

The use of gradual, intermittent, ±1 count (or similarly small) alterations of BACKGROUND and WATEROFFSET is important: large changes could be otherwise be introduced due to large spurious signals, and the controller could malfunction as a result. BACKGROUND and WATEROFFSET should be viewed as long term reference levels which do not alter much over the course of time. Indeed, over the course of years these values may change by no more than a few counts. BACKGROUND is influenced by lens transmissivity and sink reflectance (if the sense field includes the sink surface), as well as by circuit drift; WATEROFFSET is influenced primarily by lens transmissivity, and to a lesser degree by aerator performance and water pressure. Generally, these parameters do not change greatly over a very short time unless there is a corresponding change in water pressure, and so do not mandate rapid shifts in their corresponding reference levels in software.

If the PRESENCETIMEOUT timer expires, as shown in Step 136 (typically in fifteen to thirty seconds after initial proximity detection), this initiates a longer timer (five minutes or so) called MOTIONTIMEOUT as the logical flow of the process moves from the proximity detection 102 into the motion detection 104 regime.

In the motion-sensing mode illustrated in FIG. 5*c* of the drawing, changes in SIGNAL are monitored to detect hand motion. The motion-sensing process begins (in Step 140) with the initialization of a timer, called MOTIONTIMEOUT, that sets an overall limit to the time that the faucet will be allowed to run, and that is preferably set for five minutes. If MOTIONTIMEOUT expires (Step 142), the water is turned off (Step 143) and logical flow proceeds back to Step 114, where a complete recalibration is performed, and the software is essentially reset.

A second timer, called MOTIONINTERVAL, is set in Step 141 and defines an interval (which may preferably be three seconds), over which motion is to be detected. If motion is detected (in Step 144 or 145) by measuring the absolute value of the difference between a current value of SIGNAL and a previously stored value of SIGNAL acquired within the predetermined interval, the solenoid valve 40 is opened and the MOTIONINTERVAL timer is restarted (Step 146). As is shown in Step 145, for some choices of motion detection intervals and looping interval times one may choose to check for motion detection immediately after the MOTIONINTERVAL timer has expired.

If no motion is sensed during the predetermined interval the water solenoid 40 is forced off in Steps 148 and 150 (steps that may be aided by the use of a settling interval of one half second or so), and a comparison is made (in Step 152) between the current value of SIGNAL and the value of BACKGROUND (stored previously in 118 and modified in 138). If the absolute value of the difference between SIGNAL and BACKGROUND is less than a predetermined value, detection in motion mode is no longer required, and presence detection can once again be used. This might occur, for example, if a paper towel draped over the spout is removed, and reflections return to normal. In such an instance, the logical flow returns to Step 124, where presence detection is again employed. On the other hand, if the comparison In Step 152 indicates SIGNAL is significantly different from BACKGROUND, the system continues motion sensing at Step 142.

The logical steps undertaken by the microprocessor 30 thus comprise:

1. Subtracting a numerical water stream compensating value from the received signal level, at least during the time water is flowing. The subtracted value corresponds approximately to the signal level sensed from the water stream alone.
2. Using a calibration procedure that examines the received signal level both with and without water flow, the difference between these values being used to form the water stream compensating value.
3. Using a motion detection mode after a presence detection interval of some length has occurred, so as to provide at least some continued operability without causing the sensor to become disabled through a hard shutoff feature, and without allowing the waste of water, as might otherwise occur if a foreign object, such as a towel, were placed in front of the sensor.
4. Using small incremental alterations of reference levels for background reference adjustment and for adjustment of the water stream compensation term.

Various combinations of these inventive aspects allow the following advantages in the design of the faucet controller:

1. The use of predetermined sensitivity levels set at the factory obviates the need for an installer adjustment, and allows the manufacturer to avoid including an installer-accessible adjustment.
2. The use of a very broad angle sense field, encompassing even the volume of space which includes the water stream itself, maximizes a user's probability of getting his or her hands into the detection zone and thereby minimizes user frustration.

3. The continual self-calibration of the sensor, server to eliminate the need for service calls to readjust or otherwise maintain the sensor.
4. The elimination of a need to shut the controller down completely when obstacles or foreign objects are placed and left in view of the sensor, so that a user can still derive benefit from the faucet even when part of the sense field is occluded or otherwise abnormally occupied by an object.
5. An increased level of sensitivity, so as to detect hands and objects such as cups with more consistency, yet without the danger of creating a water flow lock-on condition when the sensor begins to detect reflections from the water stream itself.

Figure 6:
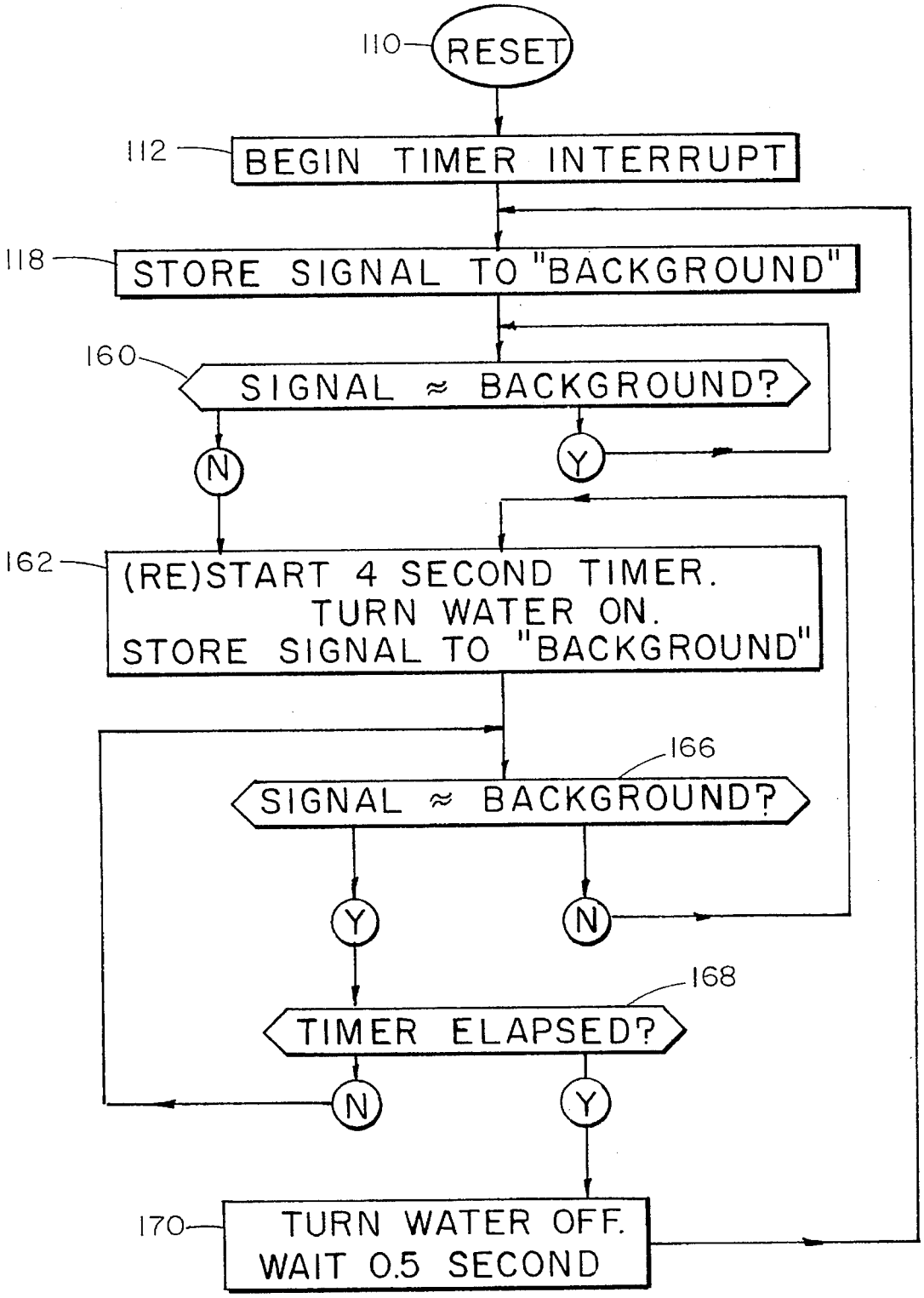
FIG. 6 of the drawing is a flow chart showing an alternate set of logical steps for a motion-sensing controller that does not also sense proximity.

FIG. 6 shows a simplified flow diagram for alternative software contained in microprocessor 30, using the same or similar hardware as previously shown in FIGS. 2 and 3 of the drawing. In this flow diagram, only a motion mode is implemented, so that deviations in detected IR cause water to flow through the solenoid valve 40 and spout 19. With only motion detection, it is not possible to detect objects held relatively still, such as coffee cups being filled. As noted supra, detection of stationary objects is simply not important in many cases. The use of motion mode allows the water stream to be ignored, so long as the undulations of the water stream alone do not cause motion to be detected. In practice it has been found to be possible to set a level of motion sensitivity that is both sensitive enough for hand washing, and that can readily ignore water stream variations.

The simplified logical flow shown in FIG. 6 begins with a reset Step 110 and proceeds with an interrupt setup 112, and an initialization of the BACKGROUND value in Step 118. In this case there is no water flow offset calculation to be made, so the current level of SIGNAL is used as the BACKGROUND value in Step 118.

Hand motion in the detection zone is considered to occur if the current value of SIGNAL differs significantly from the stored value of BACKGROUND, as indicated in Step 160. If no motion is found, the system continues in a logical loop awaiting the arrival of a user. When motion is detected an interval timer (which may preferably by a four second timer) is initialized, the water is turned on, and the current value of SIGNAL is used to replace the stored value of BACKGROUND in memory 32, as indicated in step 162. During the countdown period of the timer the current value of SIGNAL is compared with the stored value of BACKGROUND, as indicated in Step 166. If a user's hands are within the detection zone 22, a significant difference will be found and the system will loop through the motion detecting Steps 162–166. When the user's hands are removed from the detection zone 22, and the interval timer's countdown period has elapsed (as indicated in Step 168), the water is turned off and the logical process flow is returned to Step 160 where the BACKGROUND value is updated and a wait for the next user begins.

It will be recognized that a motion-only controller may be configured to adapt to a slowly varying environment, in a manner very similar to that discussed supra with regard to a proximity controller. For example, one could add adaptive steps (e.g., after Step 160 in FIG. 6) to make a small change in the stored value of BACKGROUND if no motion was detected over a preset interval.

It will also be recognized that methods of determining motion, other than the algorithm shown in FIG. 6 of the drawing could equally well be used in a motion-sensing controller. For example, one could measure the absolute value of time rate of change of the SIGNAL, and turn the faucet on if that time derivative exceeded a preset value (where changing the preset value would have an inverse effect on the controller's sensitivity to motion). Moreover, although the preceding discussion of the algorithm illustrated in FIG. 6 of the drawing made reference to a timer (which in accordance to the discussion of the proximity sensor supra could be either a hardware or a software timer) one could also implement a motion controller by using a re-triggerable one-shot circuit 92 acting to hold the faucet 10 open for a predetermined interval (such as four seconds) upon being triggered.

It is believed that the simpler, motion-only, process illustrated in FIG. 6 of the drawing is suitable for smaller capacity microprocessors and may result in a control system with an attractively lower production cost.

It will be readily apparent to practitioners of the art that numerous variations of the hardware and software can be implemented while remaining within the spirit and the scope of the invention. For example, the methodology can be realized in digital or analog hardware, with or without the use of software. A digital state machine can incorporate software flow features, for example, while filtering can be accomplished using analog components. The infrared emitter and detector can be located adjacent the spout 19, rather than within the body of the faucet 10 adjacent the top of the basin 17 as indicated in FIGS. 1*b* and 1*c* of the drawing. Moreover, a variety of other electromagnetic sources and detectors can be used in place of the near-infrared emitter 12 and photodetector 14 to detect both presence and motion in a sensing field including a flowing water stream as a portion thereof. Other such electromagnetic sources and detectors include those employing microwave radiation and visible light. It should also be clear that a variety of acoustic sensors and detectors could be used within a similar controller apparatus. Such variations can and should be readily seen to fall within the spirit and scope of the invention.

I claim:

1. In an automatic faucet controller comprising an emitter emitting electromagnetic radiation, a detector detecting said electromagnetic radiation and having as an output an electrical signal corresponding to the intensity of said detected radiation, and an electrically operated valve, said controller acting to open said valve when a user's hands proximate said faucet reflect said electromagnetic radiation from said emitter to said detector and thereby provide a said signal exceeding a threshold value, an improvement comprising means for storing a water-offset value equal to said signal corresponding to the intensity of said radiation reflected only from a stream of water from said faucet at a first predetermined time, and means for subtracting said water-offset value from said signal at a second time, subsequent to said first time, when said valve is open, and means for holding said valve open if said signal, less said water-offset value, exceeds said threshold value.

2. Apparatus of claim 1 wherein said means for subtracting said water-offset value and for holding said valve open comprises a computer and wherein said means for storing said water-offset value comprises computer memory operatively associated with said computer.

3. Apparatus of claim 1 wherein said means for storing said water-offset value comprises a predetermined source voltage and a resistor having a predetermined resistance value, wherein said means for subtracting said water-offset value comprise a summing circuit, and wherein said means for holding said valve open comprise a comparator.

4. Apparatus of claim 1 whereln said user's hand are not proximate said faucet at said first predetermined time.

5. Apparatus of claim 1 wherein said first predetermined time follows a drop in the level of said signal and precedes the closing of said valve.

6. Apparatus of claim 1 wherein said water-offset value is replaced by a second water-offset value if said signal fails to exceed the sum of said threshold value and said first water-offset value for a predetermined interval.

7. Apparatus of claim 1 further comprising a timer timing an interval commencing when said signal exceeds said threshold value, means of storing said electrical signal at a first predetermined time within said interval, means of forming, at a time subsequent to said first predetermined time and within said interval, the absolute value of the algebraic difference between the current value of said signal and said stored value thereof, said controller opening said valve if said difference exceeds a predetermined value.

8. Apparatus of claim 7 wherein said means of storing said value and said means of forming said difference comprise a computer and wherein said timer comprises a repeated software loop carried out by said computer.

9. In a motion-sensing controller for a faucet having an output stream of water reflecting pulsed electromagnetic radiation from an emitter thereof to a detector thereof, said detector having an output signal value corresponding to the intensity of said pulsed electromagnetic radiation, said controller opening an electrically actuated valve if said output signal varies by more than a first predetermined amount during a predetermined interval, an improvement comprising means for storing a water-offset value equal to the output signal value corresponding to the intensity of said radiation reflected only from said stream of water, means for subtracting said water-offset value from the output signal value at a time when said valve is open, thereby forming a difference value, said controller holding said valve open if the difference value exceeds a second predetermined amount.

10. Apparatus of claim 9 wherein said controller comprises a computer subtracting said water-offset value from the output signal value, and wherein said means for storing said water-offset value comprises a computer memory operatively associated with said computer.

11. Apparatus of claim 9 wherein said controller comprises a computer and wherein if said difference value does not exceed said second predetermined value, said computer subsequently retrieves said stored value, changes said stored value by one count and stores said changed value in place of said stored value.

12. A method of operating a faucet controller comprising an emitter of optical radiation, a detector of optical radiation having as an output an electrical signal corresponding to the intensity of said radiation received, a computer having computer memory associated therewith, and an electrically actuated valve controlled by said computer, said method comprising the steps of a) storing, in a first location in said computer memory, a water-offset value equal to said signal corresponding to radiation reflected only from a stream of water from said faucet, b) storing, in a second location in said computer memory, a threshold value, c) forming a first algebraic difference by subtracting said threshold value from said signal output at a first time and opening said valve if said first difference is greater than zero, d) forming a second algebraic difference by subtracting the sum of said threshold value and said water-offset value from said signal at a second time subsequent to said first time, and e) closing said valve if said second difference is less than zero.

13. The method of claim 12 further comprising steps d1 and d2 intermediate step d) and step e) of d1) storing a signal at a third time subsequent to said second time, d2) forming the absolute value of the algebraic difference between a signal at a fourth time subsequent to said third time and said signal stored at said third time and holding said value open for a predetermined interval if said difference exceeds a predetermined value.

14. The method of claim 12 wherein said threshold value is a predetermined amount greater than the signal corresponding to the intensity of radiation received at a predetermined time after said controller is reset.

15. A method of operating a controller for a faucet, said controller comprising an emitter of optical radiation, a detector of optical radiation having as an output an electrical signal corresponding to the intensity of radiation received, signal processing circuitry processing said detected signal, and an electrically actuated valve controlled by said signal processing circuitry, a stream of water from said faucet reflecting said radiation from said emitter to said detector, said method comprising the steps of a) comparing said detected signal to a predetermined threshold value and opening said valve if said detected signal exceeds said threshold, b) forming a difference signal by subtracting from said detected signal a water-offset value equal to said signal corresponding to radiation reflected only from said stream of water, c) comparing said difference signal to said threshold value and closing said valve if said difference signal does not exceed said threshold value.

16. The method of claim 15 wherein said controller comprises a computer having computer memory operatively associated therewith, wherein said difference signal is formed by said computer, said method further comprising the step prior to Step a) of a1) calculating said threshold value from a said value detected at a time when said valve is closed and no user of said faucet is present, and storing said threshold value in said memory.

17. The method of claim 15 wherein said threshold signal is determined by selection of a source voltage value and of the resistance value of a first resistor, wherein said water off-set signal is determined by said selection of said source voltage value and by selection of the resistance value of a second resistor, and wherein said difference signal is formed by a summing circuit.

18. A method of adapting an automatic faucet controller to environmental changes, the controller comprising an emitter emitting electromagnetic radiation, a detector detecting reflected electromagnetic radiation from the emitter, the detector having as an output an electrical signal corresponding to the intensity of the detected radiation; and an electrically operated valve having open and closed states, the controller opening the valve when a user's hands reflect a portion of the electromagnetic radiation from the emitter to the detector and are thereby detected proximate the faucet, the controller comprising a microprocessor having computer memory operatively associated therewith, the method comprising the steps of a) measuring a first signal value at a first time when the valve is closed and storing the first signal value in the memory as a stored background value, b) waiting for a predetermined interval during which the difference between the detector output and the stored background value never exceeds a predetermined value, c) measuring the current background signal value at the expiration of the predetermined interval, and d) replacing, in the computer memory, the stored background value with an adjusted background value differing from the replaced background value by a predetermined increment, the difference between the adjusted background value and the current background value less than the difference between the replaced background value and the current background value.

19. The method of claim 18 comprising additional steps intermediate steps a) and b) of:

a1) opening the valve responsive to the reflection of radiation from the user's hands;

a2) closing the valve.

20. The method of claim 18 comprising additional steps intermediate steps a) and b) of:

a1) opening the valve when the user's hands are not proximate the faucet;

a2) measuring, as a water-offset value, the signal corresponding to the radiation reflected only from a stream of water from the faucet;

a3) storing the water-offset value in the computer memory;

a4) closing the valve.

21. The method of claim 18 wherein said first time comprises a time of installation.

22. The method of claim 18 wherein said first time occurs a second predetermined interval after the controller closes the valve.

23. A motion-sensing faucet controller comprising an emitter and a detector of pulsed electromagnetic radiation, the detector having an output signal corresponding to the intensity of the pulsed electromagnetic radiation reflected from an object proximate the faucet, the controller comprising timing means and memory means, the controller receiving the output signal from the detector and storing, in the memory means, a value equal to the output signal at a first time, the controller subsequently opening an electrically actuated valve at a second time when the output signal varies from the stored value by more than a predetermined amount, the timing means initiating a first interval having a first predetermined duration when the output signal varies by more than the first predetermined amount from the stored value, the controller holding the valve open during the duration of the first interval and, if the output signal differs from the stored value by less than the predetermined amount at all times during the first interval, closing the valve at the expiration of the first interval and holding the valve closed for a second interval having a second predetermined duration.

24. The controller of claim 23 further replacing the stored value with the current value of the output signal at the expiration of the second interval.

25. The controller of claim 23 further replacing the stored value with the current value of the output signal and re-initializing the first interval whenever the valve is open and the value of the output signal differs from the then stored value by more than the predetermined amount.

26. A method of adapting an automatic faucet controller to environmental changes, the controller comprising an emitter emitting electromagnetic radiation; a detector detecting electromagnetic radiation from the emitter, the detector having as an output an electrical signal corresponding to the intensity of the detected radiation; and an electrically operated valve having open and closed states, the controller opening the valve when a user's hands reflect a portion of the electromagnetic radiation from the emitter to the detector and are thereby detected proximate the faucet, the controller comprising a microprocessor having computer memory operatively associated therewith, the method comprising the steps of:

a) storing a predetermined value in the memory at a first time prior to a time of installation, b) installing the controller and waiting for a predetermined interval;

c) measuring the current value of the signal at the expiration of the predetermined interval; and d) replacing, in the computer memory, the stored predetermined value with a first background value differing from the replaced predetermined value by a predetermined increment, the difference between the first background value and the current value less than the difference between the replaced value and the current value.

27. The method of claim 26 further comprising steps after step d) of:

e) waiting a second predetermined interval during which the difference between the detector output and the stored background value never exceeds a predetermined threshold value;

f) measuring a second current signal value at the expiration of the second predetermined interval, and g) replacing, in the computer memory, the stored first background value with a second adjusted background value differing from the stored background value by the predetermined increment, the difference between the second background value and the second current value less than the difference between the stored background value and the second current value.

28. A method of operating an automatic faucet controller comprising an emitter emitting electromagnetic radiation, a detector detecting electromagnetic radiation from the emitter, the detector having as an output an electrical signal corresponding to the intensity of the detected radiation; and an electrically operated valve having open and closed states, the controller opening the valve when a user's hands reflect a portion of the electromagnetic radiation from the emitter to the detector and are thereby detected proximate the faucet, the controller comprising a microprocessor having computer memory operatively associated therewith, the method comprising the steps of a) resetting the microprocessor;

b) controlling the valve to be in the closed state;

c) waiting a first predetermined interval;

c) storing the signal corresponding to the intensity of the detected radiation at the end of the first predetermined interval in the computer memory as a background value; and d) thereafter opening the valve only when the signal exceeds the background value by a first predetermined amount.

29. The method of claim 28 further comprising additional steps intermediate steps a) and b) of:

a1) controlling the valve to be in the open state;

a2) waiting a second predetermined interval;

a3) storing the signal corresponding to the intensity of the detected radiation at the end of the second predetermined interval in the computer memory as a STEPSIGNAL value;

the method further comprising additional steps intermediate steps c) and d) of c1) subtracting the background value from the STEPSIGNAL value and storing the difference so formed in the computer memory as a water-offset value;

and wherein the first predetermined amount in step d) comprises the algebraic sum of the water-offset value and a predetermined incremental amount.

* * * * *